United States Patent [19]

Kastinger

[11] 4,194,309

[45] Mar. 25, 1980

[54] SKI BOOT

[76] Inventor: Hermann Kastinger, A 4863 Seewalchen, Austria

[21] Appl. No.: 961,002

[22] Filed: Nov. 15, 1978

Related U.S. Application Data

[63] Continuation-in-part of Ser. No. 865,231, Dec. 27, 1977, abandoned.

[51] Int. Cl.[2] ..... A43B 5/04

[52] U.S. Cl. ..... 36/117; 36/132

[58] Field of Search ..... 36/132, 117, 118, 119, 36/120, 121, 105, 25 R, 30 R, 31

[56] References Cited

U.S. PATENT DOCUMENTS

| | | | |
|---|---|---|---|
| 3,971,144 | 7/1976 | Brugger-Stuker | 36/117 |
| 4,155,179 | 5/1979 | Weninger | 36/117 |

*Primary Examiner*—Patrick D. Lawson

*Attorney, Agent, or Firm*—Hill, Van Santen, Steadman, Chiara & Simpson

[57] ABSTRACT

A ski boot is here disclosed as having a sole and a leg sheath. The sheath has a forwardly inclined axis and the boot being comprised of a relatively rigid material. A boot heel is mounted on said sole and has upper and lower heel parts. A lower heel part socket is positioned forwardly of said heel and is shaped to receive the lower heel part. A hinge connects the upper and lower heel parts in hinged assembly together with the lower heel part being operable to function to provide a support for the upper heel part when the ski boot is in a first standing position and with the upper heel part then being in overlying relation to the lower heel part. The lower heel part is swingable on the hinge to a position to one side of said lower heel part and into said socket, thus exposing the upper heel part, thus enabling the wearer to walk more comfortably. The upper heel part is so sized with respect to the sole and the lower heel part to enable it to then function to engage ground when the boot is in a second more upright standing position whereby the inclined axis of the leg sheath is moved so that the boot wearer can walk with a more upright posture.

22 Claims, 7 Drawing Figures

SKI BOOT

The present application is a continuation-in-part of my copending application entitled "Ski Boot", U.S. Ser. No. 865,231, filed Dec. 27, 1977, and now abanded.

BACKGROUND OF THE INVENTION

1. Field of the Invention

The invention relates to a boot, particularly a ski boot having a rigid sheath and a rigid sole as it is presently used for Alpine skiing.

2. Prior Art

With modern ski boots, designated for downhill or Alpine skiing, walking and standing without skis is rather uncomfortable, particularly when ski boots of the type commonly used nowadays have a relatively rigid sole and a relatively rigid sheath. The discomfort experienced by skiers today is increased because the ski boot has a relatively high sheath directed forwardly in a direction generally toward the toe end of the ski boot so that the tibia of the skier is forced into the forward position expedient for downhill skiing.

Indeed, attempts have been made to improve walking with the ski boot by providing a boot with a boot sole that is rounded towards the tip of the boot and which rises towards the heel end. Ski boots have been constructed, whose soles and/or sheaths, respectively, are less stiff in certain parts than in others in order to facilitate at least some bending through of the sole and the sheath during walking. Indeed, these measures may afford a certain rolling off of the boot over the front and back edge of its sole when walking in the ski boot without skis which, however, leaves room for improvement as the rounding out of the boot sole towards the boot tip and towards the heel end is possible only in a limited degree if a tight fit of the ski boot and the ski binding and the great bending resistance of boot sole and boot sheath, desired for skiing, are not to be considerably impaired. Walking aids in the form of blocks or the like were also suggested which can be disposed underneath the ball area of the boot sole and are used to facilitate a rolling off of the boot across or over the block during walking without skis. These walking aids are also used to lift the boot tip and thus to give the boot a different standing surface or position so as to adjust for the forward incline of the boot sheath. These walking aids have certain disadvantages. By placing the aids underneath the ball area of the boot sole, the whole ski boot is elevated, which again produces discomfort and little feeling of safety, particularly during walking. The aids can also be lost and are cumbersome to attach to the ski boot.

SUMMARY OF THE INVENTION

The object of this invention is to construct a ski boot of the initially mentioned type so that two different standing positions can be provided with one position allowing the wearer to walk in a comfortable manner without skis and while still enabling the skier to use the ski boot while skiing without impairing the function of the boot. A still further object is to provide a new and improved ski boot having a forwardly angled sheath for snug engagement about the lower leg area of the wearer so the boot can be effectively used both while skiing and after skiing as a walking boot without requiring walking aids which have to be put on independently or detached therefrom.

This objective is attained by providing a boot heel that includes a lower part which is hinged to the upper part so that it can be pivoted up from its functioning position from below the upper heel part where it provides a first standing position of the boot into a second rest position which exposes this upper heel part so that its lower surface can be located above the plane of a lower former ground engaging surface of the lower heel part of the boot to then enable the boot to be supported by an underside surface of the upper heel part.

The term "heel" as here used is intended to represent the generally rear sole area, particularly in shoes essentially having a plane sole, without a heel projecting from the shoe tip to the heel of the foot. Thereby, for example, a ski boot can be provided with such a standing position, on one hand, in which its sheath has a forward incline suitable for skiing, and on the other hand, it is provided with a standing position advantageous for walking and standing without skis, in which the sheath essentially has no forward incline. When a lower heel part is pivoted up, the boot then can rest on a floor surface and in effect causes the forward tip of the sole to flip backwards so the bottom surface of the lower heel part rests on the floor surface, whereby the sheath axis attains a vertical or more upright position. Thus, by pivoting of the lower heel part as described, the standing elevation of the boot can be simultaneously decreased which is of considerable advantage for the feeling of safety of the wearer of the boot during walking and standing.

In a boot which has sunken or drawn-up hinge area between a heel, projecting downwardly, and the ball area of the sole, the lower heel portion can be pivoted about a transverse or lateral axis, which is located at a front side of the heel, into a space or socket underneath the sunken or drawn-up hinged area of the sole. However, it is also possible that the lower heel part can be essentially pivoted up about a transverse axis, located at the rear part of the heel on a rear side of the sheath or it can also be pivoted up about a longitudinal axis located on a longitudinal side of the heel and thus into abutment with a rear lateral side area of the boot, which are modifications.

The height of the lower heel part is expediently proportioned so that with a pivoted-up lower heel part, the standing position of the boot, resulting thereby, extends substantially perpendicularly to the sheath axis, whereby the underside of the upper part of the heel advantageously extends in a parallel position in relation to the standing position. Moreover, it can be of advantage if the underside of the upper heel part is rounded upwardly near its rear edge.

According to other features of this invention several different means are disclosed for securing the lower heel part in alternative positions either in secured relationship with the upper heel part or secured in a position to one side of the lower heel part thereby enabling the upper heel part to engage the ground thus positioning the boot in a more upright standing position whereby the inclined axis of the leg sheath is moved so that the boot wearer can walk with a more upright posture.

Several particularly advantageous embodiments of the new and improved ski boot are illustrated in the attached drawings. The drawings illustrate the following:

AS SHOWN ON THE DRAWINGS

Figure 1:
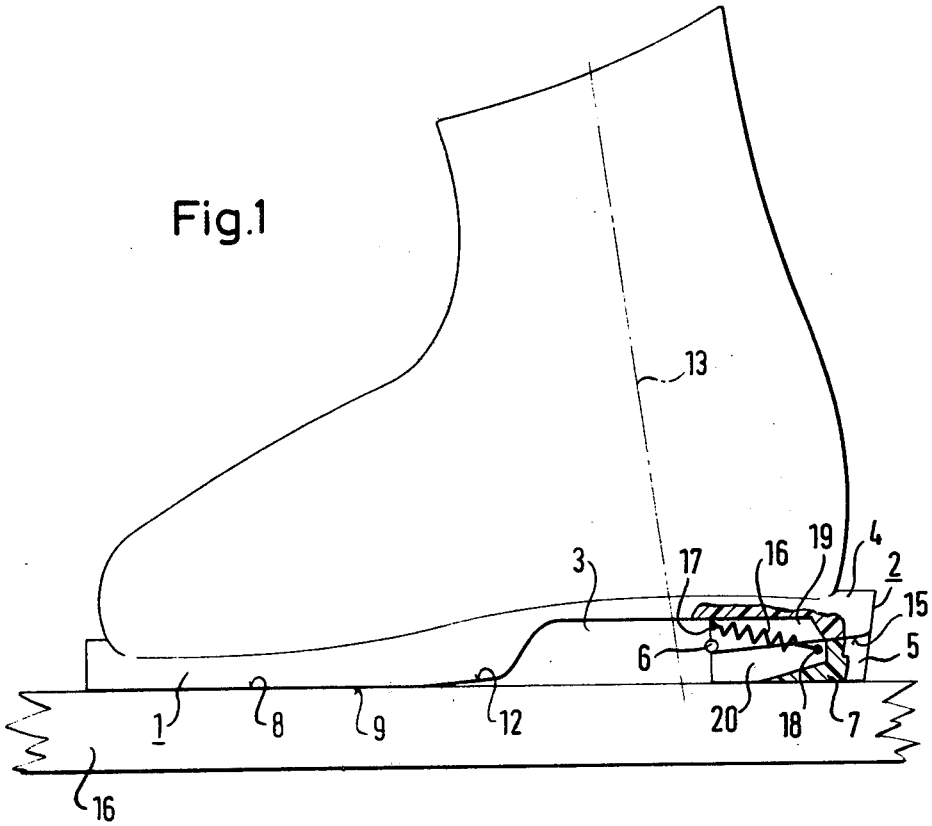
FIG. 1 shows a side view of a ski boot in a standing position suitable for skiing.

In the illustrated sample embodiment, the boot sole is drawn up in its hinged area which is located between a ball area 1 and the heel 2, so that a hollow space or socket 3 results above a standing surface at the underside of the ski boot. The boot heel is subdivided into a upper part 4, fastened at the boot sheath, and into a lower heel part 5. The lower heel part 5 is connected to the upper heel part 4 at the front side of the heel by a hinge, so that it can be pivoted into a functioning position in which the two heel parts 4 and 5 lie directly superimposed, said functioning position being located underneath the upper heel part 4, on the one hand, or it can be pivoted into the hollow space or socket 3 underneath the drawn-up boot sole. In FIG. 1, the lower heel part 5 is in its first functioning position underneath the upper heel part 4, and in FIG. 2, it is in its second rest position in the hollow space or socket 3.

In the functioning position of the lower heel part 5, the ski boot has a standing surface 9 which is formed by an underside 7 of the lower heel part 5 and of the underside 8 of the ball area 1 of the boot sole, so that it can rest on the ski 16 with a sheath or shaft axis 13, inclined forwardly. With the lower heel part 5 pivoted into the hollow space 3, the ski boot has a second standing surface 10 which is formed by the underside 11 of the upper heel part 4 and the rear, somewhat drawn-up edge 12 of the underside 8 of the ball area 1 of the boot sole. The two standing surfaces 9,10 form an angle in relation to one another which approximately corresponds with the angle between the sheath axis 13 when the lower heel part 5 is in functioning position, and the sheath axis 14 when the lower heel part is in position of rest.

Figure 2:
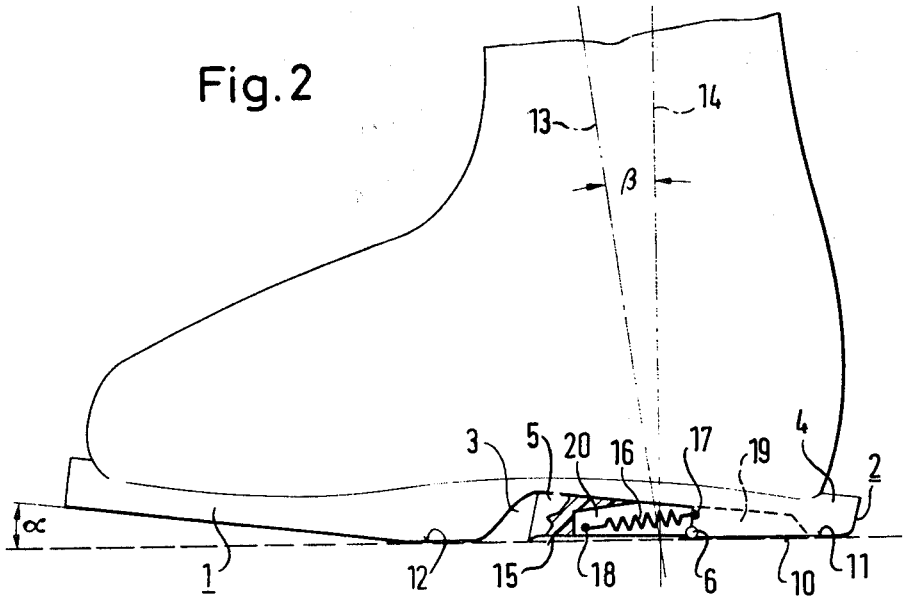
FIG. 2 shows a side view of the same boot but in another standing position that illustrates how the ski boot can be used for walking and standing after the skis have been detached.

In the embodiment illustrated in FIGS. 1 and 2, by way of example, it may be expedient that the underside of the lower heel part 5 which forms one part of the standing surface 9 of the ski boot, is relatively smooth having a low coefficient of friction in order to facilitate the sliding off of the ski boot from the ski when the safety binding is released. On the other hand, the underside 11 of the upper heel part 4, which forms a part of the standing surface 10 of the ski boot can be constructed with a rough bottom face having a high coefficient of friction in order to safeguard a holding of the ski boot on snow and ice surfaces. For the same purpose, surface 15 of the lower heel part 5 and the upper heel part 4, which faces downwardly can be provided with a rough surface having a high coefficient of friction, said surface abutting the underside 11 of the upper heel part in the functioning position of the lower heel part.

In the embodiment shown in FIGS. 1 and 2, the lower part of the heel 5 is held in both positions by a spring tension device 16, which is located in each of the recesses 19,20 in the lower part of the heel 5 and in the upper part thereof 4. The spring tension device is pivotally connected to the upper hollow heel part 4 and to the lower hollow heel part 5 at its opposite ends indicated at 17 and 18 within the superimposed recesses 19 and 20.

Figure 3:
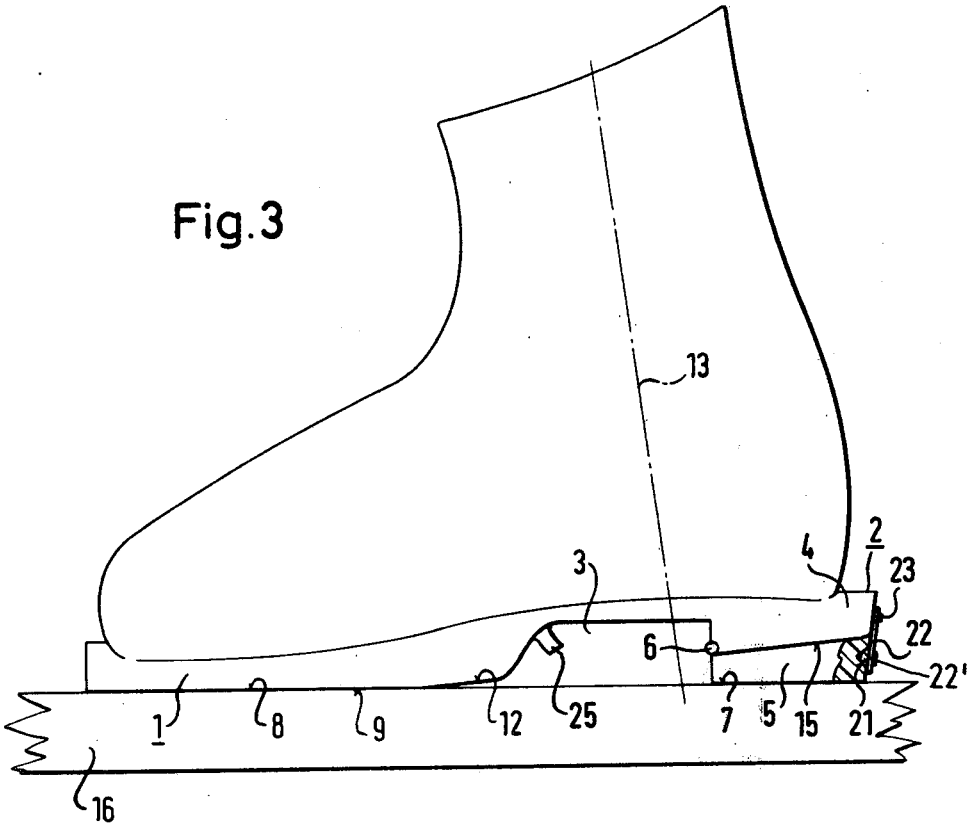
FIGS. 3 and 4 are side elevations of a modified form of a ski boot showing the heel parts in varied positions relative to one another.
Figure 5:
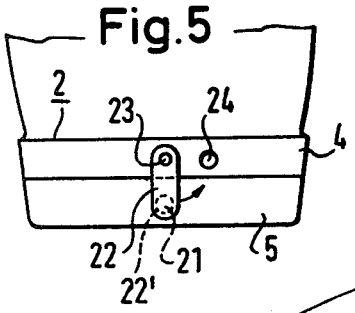
FIG. 5 is a fragmentary rear elevation of the ski boot of the figures shown in FIGS. 3 and 4.
Figure 4:
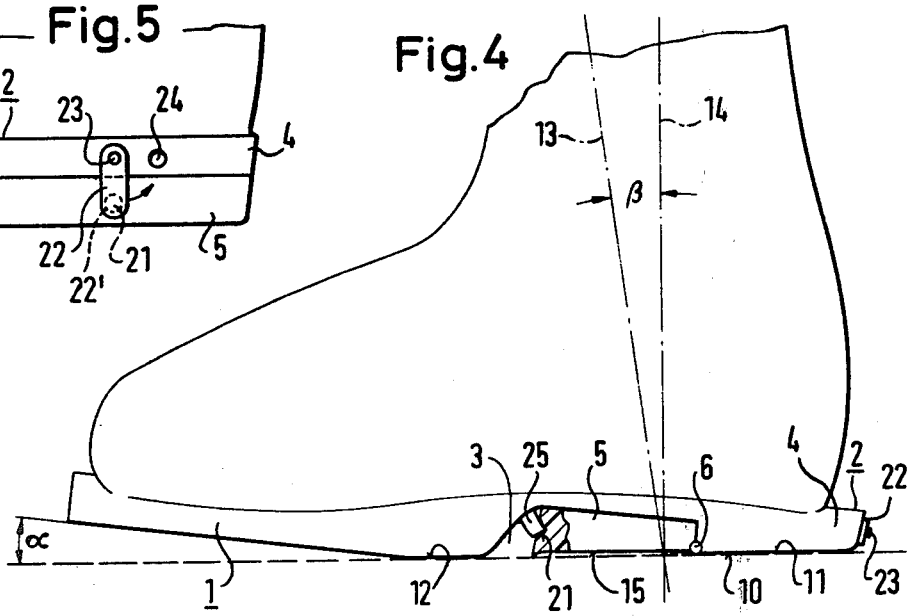

In the modified boot construction shown in FIGS. 3, 4 and 5, the lower heel part 5 has a notch 21. In the position shown in FIG. 3, a sole mounted stud 25 engages in the notch or socket 21 for securing the lower heel part in its forward position. At this time a stud portion 22' located on a rotating latch arm 22 is engaged in a retaining notch 24 on the upper heel part 4 to secure the free end of the latch arm from uncontrolled movement. When the latch arm 22 is free of the retaining notch 24, it is pivotable around an axis 23 on the rear side of the upper part 4 of the heel. The pivoting capability is shown in FIG. 5. In the position shown in FIG. 4 of the heel part 5, the latch arm 22 can be pivoted upwards so that the stud portion 22' can rest in the notch 24, which is located next to axis 23 on the rear side of the upper heel part 4. When it is desired to secure the heel parts in superimposed fixed stacked assembly, the stud portion 22' can be engaged in the notch 21 on the lower heel part, thereby prohibiting relative movement between the heel parts. In the position actually shown in FIG. 4, a stud 25 rests in the lower heel part notch 21 on the heel part 5 for securing the upper and lower heel parts 2 and 4 in fixed side-by-side or end-to-end assembly. The stud 25 is partially embedded in the sole and secured to the sole of the boot so that assembly of the stud 25 with the boot is insured.

Figure 6:
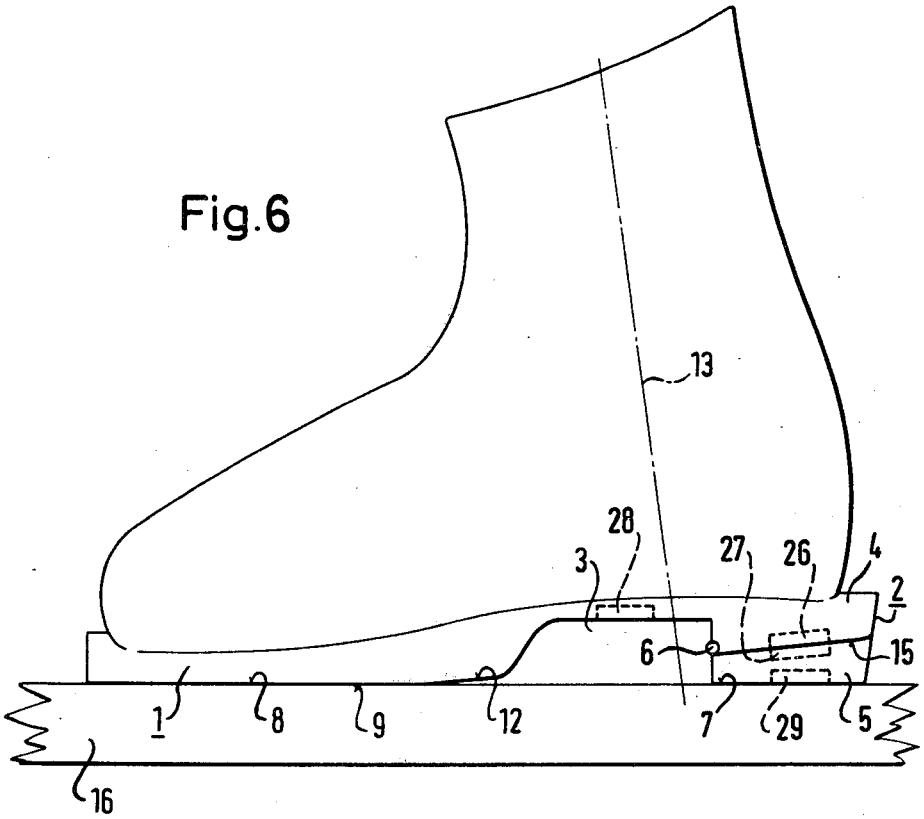
FIGS. 6 and 7 are side elevations of a still further modified boot showing the heel parts in varied positions relative to one another.
Figure 7:
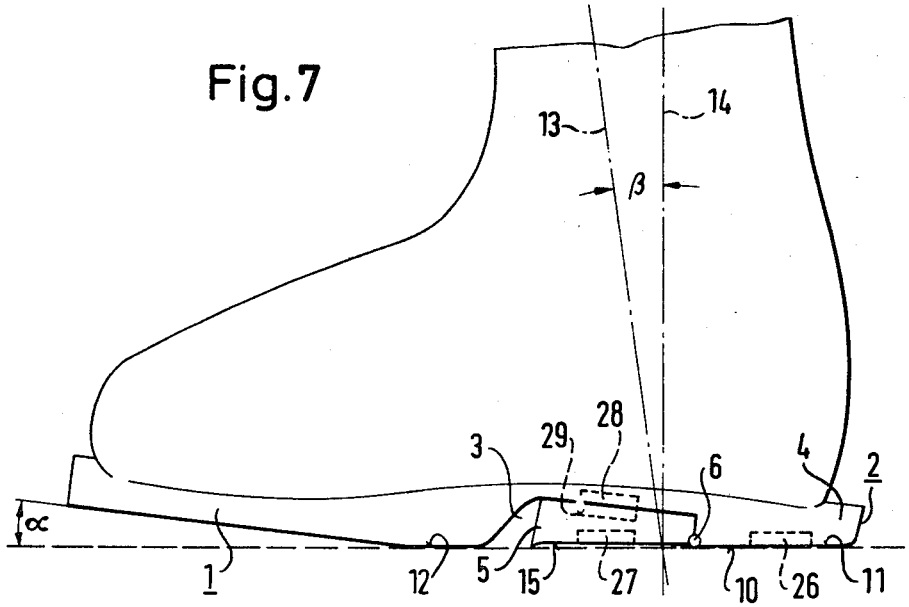

In the embodiment shown in FIGS. 6 and 7, the lower heel part 5 is secured in both positions by magnets 26, 27, 28, 29. The construction and operation of the heel parts and the boot are otherwise the same as those boots previously described excepting with respect to the means for securing the lower heel part in its respective positions.

I claim as my invention:

1. A ski boot having a sole and a leg sheath with a forwardly inclined axis and with the boot being comprised of a relatively rigid material, a boot heel mounted on said sole and having upper and lower heel parts, a lower heel part socket positioned forwardly of said heel, a hinge connecting said upper and lower heel parts in hinged assembly together, the lower heel part being operable to function to provide a support for the upper heel part when the ski boot is in a first standing position and with the upper heel part then being in overlying relation to the lower heel part, the lower heel part being swingable on said hinge to a position to one side of said lower heel part and into said socket, thus exposing the upper heel part, the upper heel part being so sized with respect to said sole and said lower heel part enabling it to then function to engage ground when said boot is in a second more upright standing position whereby the inclined axis of the leg sheath is moved so that the boot wearer can walk with a more upright posture.

2. A ski boot having a sole and a leg sheath in integral assembly and comprised of a relatively rigid material, a boot heel mounted on said sole and having upper and lower heel parts, a hinge connecting said upper and lower heel parts in hinged assembly together, the lower heel part being operable to function to provide a support for the upper heel part when the ski boot is in a first standing position and with the upper heel part then being in overlying relation to the lower heel part, the lower heel part being swingable on said hinge to one side of said lower heel part thus exposing the upper heel part, the upper heel part being so sized with respect to the said sole and said lower heel part enabling it to then function to engage ground while said boot remains in a second more upright standing position.

3. The ski boot of claim 2 further characterized by the leg sheath being forwardly inclined and including a forwardly inclined sheath axis when the lower heel part is positioned beneath the upper heel part when the boot is in said first standing position and with the sheath axis being in a relatively perpendicular position when the lower heel part is pivoted on its hinge and when the boot is positioned in its second standing position.

4. The ski boot as defined in claim 2, wherein the lower heel part can be pivoted on its hinge about a transverse axis at the underside of the sole for disposition at a ball area of the boot sole into a position in front of the upper heel part.

5. The ski boot as defined in claim 2, wherein the hinge is located in a hinge socket area in the upper heel part providing a transverse hinged axis located at a front side of the upper heel part and with the lower heel part being swingable into a socket formed between a hinge socket area and a bottom surface of the sole.

6. The ski boot of claim 5, wherein the lower heel part is pivotable about said transverse axis into said socket.

7. The ski boot as defined in claim 2 further characterized by said hinge being so located as to provide a longitudinal axis and enabling the lower heel part to be swung out of underlying engagement with said upper heel part and into side-by-side engagement with said boot sheath.

8. The ski boot as defined in claim 2, wherein the upper heel part has a lowermost inclined second standing surface which rises towards the rear side of the heel, thus enabling an axis of the boot sheath to be moved rearwardly thus allowing the wearer to walk in a more upright position as compared to where the lower heel part is positioned in underlying relation to the upper heel part.

9. The ski boot as defined in claim 8, wherein the plane of the underside of the upper heel part extends approximately perpendicularly to the sheath axis.

10. The ski boot as defined in claim 2, wherein the upper heel part is rounded upwardly near its rear edge.

11. The ski boot as defined in claim 2, wherein the underside ground engaging surface of the upper heel part is provided with a rough surface for the development of substantial friction against sliding when a wearer is using the boot as a walking boot rather than as a ski boot.

12. The ski boot as defined in claim 2, wherein an underside surface of the lower heel part is provided with a relatively smooth surface to minimize friction.

13. The ski boot as defined in claim 2, wherein means is provided for tightly securing the lower heel part in engagement with said upper heel part or alternatively in said socket when said boot is to be used as a walking boot.

14. The ski boot as defined in claim 2, wherein means is provided for tightly securing the lower heel part in engagement with said upper heel part or alternatively in said socket when said boot is to be used as a walking boot.

15. The ski boot as defined in claim 2, wherein said hinge is positioned at a forward edge of the upper heel part and with said socket being positioned immediately forward of said hinge and said upper heel part and being of sufficient geometrical size to receive said pivoted lower heel part thereby enabling a lower surface of the upper heel part to cooperate with said sole and to jointly act with said sole to provide a ground support for said boot.

16. The ski boot as defined in claim 15, further characterized by said hinge being positioned at a rear side of the heel and with said lower heel part pivotable about a transverse axis on a rear side of said leg sheath.

17. The ski boot as defined in claim 2, wherein the sole forward of the socket at a tip end of the ski boot is elevated out of ground engagement as compared with an area of the sole immediately forward of the socket providing the ski boot with ground engaging support areas at least at opposite sides of said socket and with a vertical axis of the leg sheath being positioned in a plane essentially perpendicular to the ground engaging surface area of the sole and of the upper heel part.

18. The ski boot of claim 2 further characterized by means joined between the sole and the lower heel part for fixedly securing the lower heel part against the upper heel part or forwardly against the sole.

19. The ski boot of claim 18 further characterized by said means comprising a spring tension device secured at opposite ends to the upper and lower heel parts and with the spring tension device being so positioned relative to the heel parts so as to exert a retaining action for holding the lower heel part firmly fixed when in either of its adjusted positions.

20. The ski boot of claim 18 further characterized by said means comprising oppositely polarized magnets with magnets embedded in the upper and lower heel parts and forwardly in the sole.

21. The ski boot of claim 18 further characterized by a sole mounted stud being carried on the sole forward of the heel parts and with the lower heel part being moveable into its forward position and with said stud being engageable in a notch in the lower heel part for fixedly securing the lower heel part in its forward position.

22. The ski boot of claim 18 further characterized by said means including a rotating latch arm on one of said heel parts and having a stud portion thereon and with a socket being located on the other of the heel parts and with the stud portion being engageable in the socket for securing the heel parts in assembly together.

* * * * *